US007631730B2

(12) United States Patent
Anasis et al.

(10) Patent No.: US 7,631,730 B2
(45) Date of Patent: Dec. 15, 2009

(54) POWERED CONTROLLED ACCELERATION SUSPENSION WORK PLATFORM HOIST SYSTEM

(75) Inventors: George M. Anasis, Lewis Center, OH (US); Robert E. Eddy, Johnstown, OH (US); Gary E. Ingram, Lady Lake, OH (US); Jean-Francois DeSmedt, Herbais (BE)

(73) Assignee: Sky Climber, LLC, Delaware, OH (US)

( * ) Notice: Subject to any disclaimer, the term of this patent is extended or adjusted under 35 U.S.C. 154(b) by 956 days.

(21) Appl. No.: 11/267,629

(22) Filed: Nov. 4, 2005

(65) Prior Publication Data

US 2007/0102242 A1 May 10, 2007

(51) Int. Cl.
*B66B 1/28* (2006.01)

(52) U.S. Cl. ..... 187/296; 187/224; 182/148

(58) Field of Classification Search ..... 187/251, 187/222, 224, 277, 284, 289, 293, 296; 182/13, 182/14, 19, 130, 131, 141–148; 254/267, 254/290, 316, 339, 340, 362; 318/59, 61, 318/64, 68, 276, 278

See application file for complete search history.

(56) References Cited

U.S. PATENT DOCUMENTS 3,817,346 A * 6/1974 Wehmeyer ..... 182/14
RE28,455 E * 7/1975 Denier et al. ..... 182/16
4,462,484 A 7/1984 Crudele
4,821,842 A 4/1989 Cavalieri
5,167,401 A 12/1992 James et al.
6,247,680 B1 6/2001 Cohen
6,405,114 B1 6/2002 Priestley et al.
6,598,859 B1 7/2003 Kureck et al.
6,848,675 B2 * 2/2005 Davis et al. ..... 254/340
2008/0087497 A1 * 4/2008 Boswell et al. ..... 182/142
2008/0174955 A1 * 7/2008 Eddy et al. ..... 361/688

* cited by examiner

*Primary Examiner*—Jonathan Salata
(74) *Attorney, Agent, or Firm*—Gallagher & Dawsey, Co., LPA; Michael J. Gallagher; David J. Dawsey

(57) ABSTRACT

A powered controlled acceleration suspension work platform hoist system for raising and lowering a work platform at a predetermined acceleration. The system incorporates several hoists attached to the work platform and in electrical communication with the motor control system. The motor control system is attached to the work platform and is in electrical communication with a constant frequency input power source and the hoist motors. The motor control system controls the acceleration of the work platform as it is raised and lowered by controlling the hoist motors. The controlled acceleration hoist system also includes a platform control system attached to the work platform that is in electrical communication with the motor control system and the hoist motors. Acceleration control is achieved by converting the constant frequency input power to a variable frequency power supply. This may be accomplished through the use of a variable frequency drive(s).

27 Claims, 12 Drawing Sheets

POWERED CONTROLLED ACCELERATION SUSPENSION WORK PLATFORM HOIST SYSTEM

TECHNICAL FIELD

The instant invention relates to powered suspended work platform hoist system, particularly a system that controls the acceleration of a suspended work platform.

BACKGROUND OF THE INVENTION

Suspension type work platforms, also commonly referred to as access platforms, are well-known in the art. Such platforms are typically powered by a hoist at each end of the platform that raises and lowers the platform on an associated suspension wire at each end. The hoists are generally very simple machines including an electric motor, a gearbox, and a traction mechanism that grips the wire. Generally the electric motors are single-speed motors, however two-speed motors are available. Traditionally the motors incorporate across-the-line starters and therefore switch from off to full speed at the press of a button. The gearboxes reduce the motor speed resulting in a platform velocity generally ranging from 27 feet per minute (fpm) to 35 fpm. Therefore, the acceleration of the work platform from standing to 27 fpm, or more, essentially instantaneously is jarring and dangerous, not only to the occupants but also the roof beams, or anchorage points.

Similarly, traditional systems offer no control over a powered deceleration of the work platform. This is particularly problematic when trying to stop the work platform at a particular elevation since the platform approaches the elevation at full speed and then stops instantaneously. This crude level of control offered by traditional systems results in repeated starting, stopping, and reversing, or "hunting," before the desired elevation is obtained. Such repeated starts and stops not only prematurely wear the equipment, but are dangerous to the work platform occupants.

What has been missing in the art has been a system by which the users, employers, or equipment manufacturers can control the acceleration of the work platform. Further, a system in which the velocity can be adjustably limited depending on the particular working conditions is desired.

SUMMARY OF INVENTION

In its most general configuration, the present invention advances the state of the art with a variety of new capabilities and overcomes many of the shortcomings of prior devices in new and novel ways. In its most general sense, the present invention overcomes the shortcomings and limitations of the prior art in any of a number of generally effective configurations. The instant invention demonstrates such capabilities and overcomes many of the shortcomings of prior methods in new and novel ways.

The present invention is a powered controlled acceleration suspension work platform hoist system for raising and lowering a work platform at a predetermined acceleration. The work platform is raised and lowered on at least two wire ropes. The powered controlled acceleration suspension work platform hoist system includes at least two hoists, referred to as a sinistral hoist and a dextral hoist. The hoists are releasably attached to the work platform. Each hoist has a motor in electrical communication with a variable acceleration motor control system. The variable acceleration motor control system is releasably attached to the work platform and is in electrical communication with a constant frequency input power source and the hoist motors.

The variable acceleration motor control system controls the acceleration of the work platform as it is raised and lowered, under power, on the ropes by controlling the hoist motors. The powered controlled acceleration suspension work platform hoist system also includes a platform control system releasably attached to the work platform that is in electrical communication with the variable acceleration motor control system and the hoist motors. The platform control system has a user input device designed to accept instructions to raise or lower the work platform.

The variable acceleration motor control system not only controls the acceleration of the work platform in the conventional sense of positive acceleration, but it also controls the negative acceleration, or deceleration, of the work platform. This provides the ability to slowly approach a particular elevation, from above or below, in a controlled fashion so that the elevation is not passed, or overshot.

The variable acceleration motor control system controls the acceleration of the work platform so that it reaches a maximum velocity in no less than a predetermined time period. The time period is a minimum of 1 second, but is more commonly 2-5 seconds, or more depending on the use of the work platform. In one embodiment the variable acceleration motor control system achieves the acceleration control by converting the constant frequency input power to a variable frequency power supply. This may be accomplished through the use of a variable frequency drive that converts the constant frequency input power source to a variable frequency power supply connected to the hoist motors. The system may incorporate one variable frequency drive that controls both motors, an individual variable frequency drive for controlling each motor separately, or a variable frequency drive for each hoist that can control both motors, as will be disclosed in detail in the Detailed Description of the Invention. Variations of the platform control system may include a GPS tracking system as well as a remote wireless transmitter and a receiver. In such variations, the remote wireless transmitter transmits commands to the receiver using spread spectrum communications. Additionally, the remote wireless transmitter may include some, or all, of the controls of the user input device(s). These variations, modifications, alternatives, and alterations of the various preferred embodiments may be used alone or in combination with one another, as will become more readily apparent to those with skill in the art with reference to the following detailed description of the preferred embodiments and the accompanying figures and drawings.

BRIEF DESCRIPTION OF THE DRAWINGS

Without limiting the scope of the present invention as claimed below and referring now to the drawings and figures:

DETAILED DESCRIPTION OF THE INVENTION

The powered controlled acceleration suspension work platform hoist system (10) of the instant invention enables a significant advance in the state of the art. The preferred embodiments of the device accomplish this by new and novel arrangements of elements and methods that are configured in unique and novel ways and which demonstrate previously unavailable but preferred and desirable capabilities. The detailed description set forth below in connection with the drawings is intended merely as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention.

Figure 16:
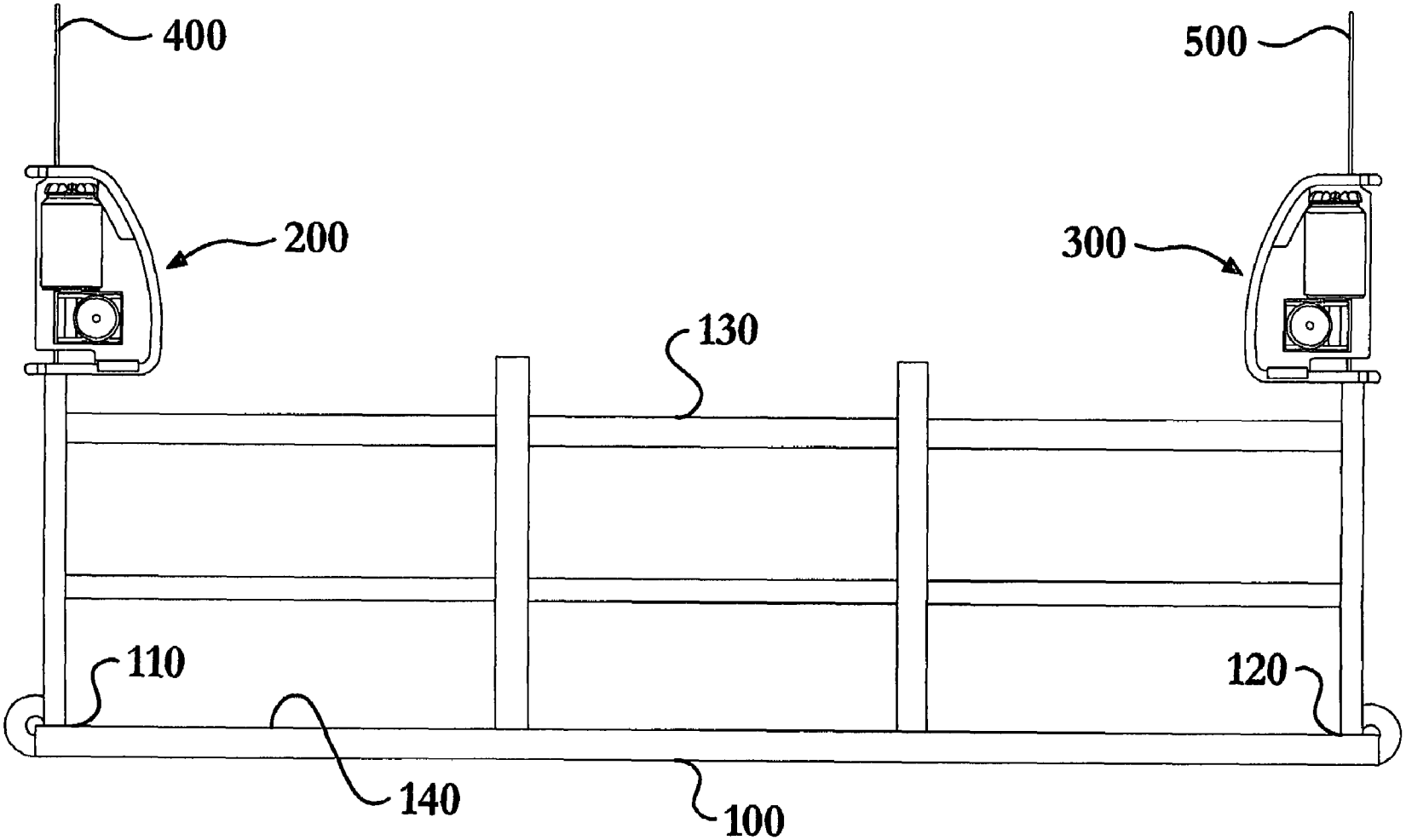
FIG. 16 is a front elevation view of a work platform.

The present invention is a powered controlled acceleration suspension work platform hoist system (10) for raising and lowering a work platform (100) at a predetermined acceleration. As seen in FIG. 16, the work platform (100) is raised and lowered on two wire ropes, namely a sinistral rope (400) and a dextral rope (500). Additionally, the work platform (100) has a sinistral end (110) and a dextral end (120). The powered controlled acceleration suspension work platform hoist system (10) includes a sinistral hoist (200) that is releasably attached to the work platform (100) near the sinistral end (110) and cooperates with the sinistral rope (400), and a dextral hoist (300) that is releasably attached to the work platform (100) near the dextral end (110) and cooperates with the dextral rope (500). Now, referring to FIGS. 10-15, the sinistral hoist (200) has a sinistral motor (210) and the dextral hoist (300) has a dextral motor (310), and both motors (210, 310) are in electrical communication with a variable acceleration motor control system (600). While FIGS. 10-15 illustrate only the sinistral hoist (200) and its components, the same figures apply equally to the dextral hoist (300) since they are identical, merely substituting 300 series element numbers in place of the 200 series element numbers.

Figure 1:
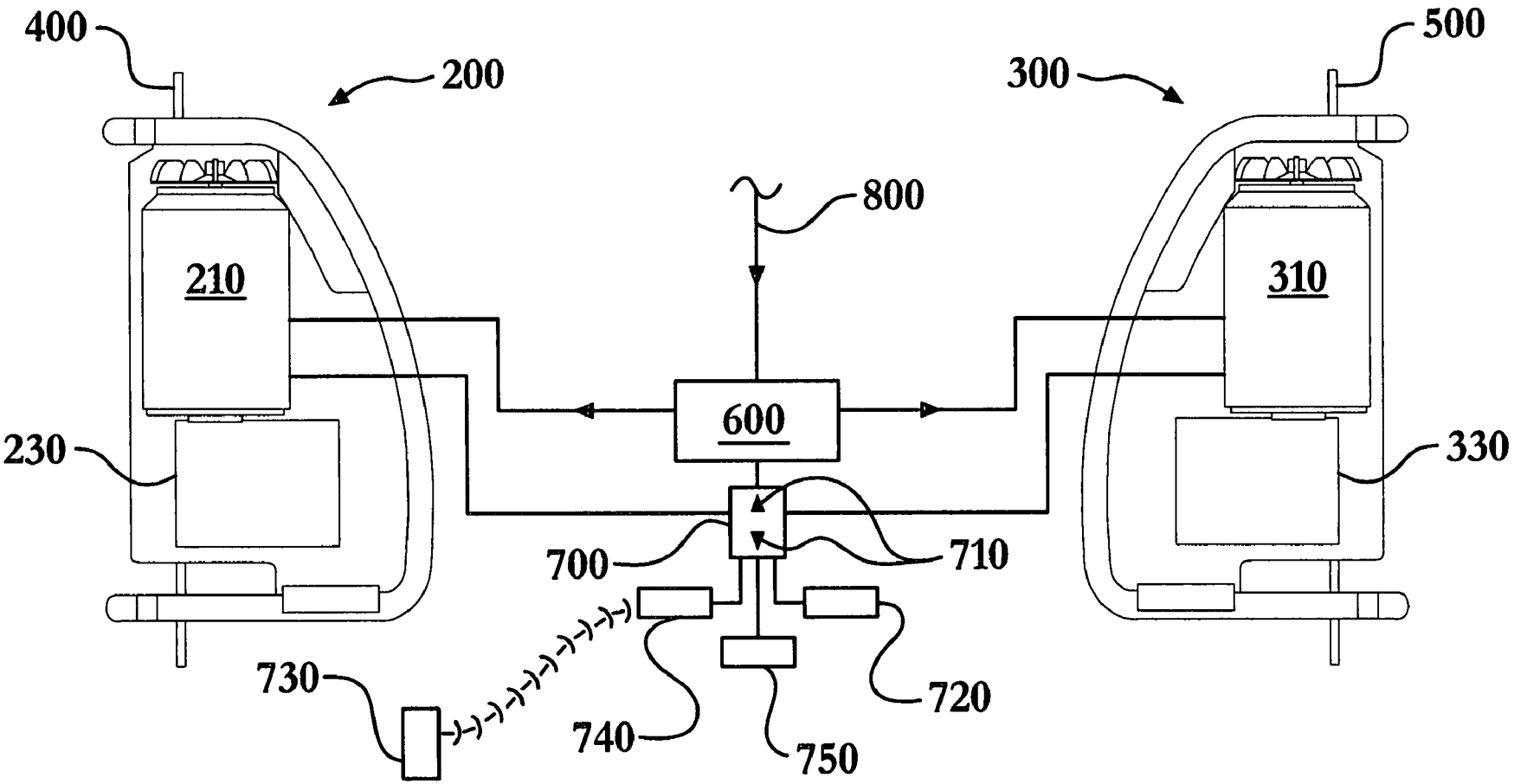
FIG. 1 is a schematic of the suspension work platform hoist system of the present invention, not to scale.

With reference now to FIG. 1, the variable acceleration motor control system (600) is releasably attached to the work platform (100) and is in electrical communication with a constant frequency input power source (800) and the sinistral motor (210) and the dextral motor (310). The variable acceleration motor control system (600) controls the acceleration of the work platform (100) as the work platform (100) is raised and lowered on the sinistral rope (400) and the dextral rope (500) by controlling the sinistral motor (210) and the dextral motor (310). Lastly, the powered controlled acceleration suspension work platform hoist system (10) includes a platform control system (700) releasably attached to the work platform (100) and in electrical communication with the variable acceleration motor control system (600), the sinistral motor (210), and the dextral motor (300), and has a user input device (710) designed to accept instructions to raise or lower the work platform (100).

Figure 11:
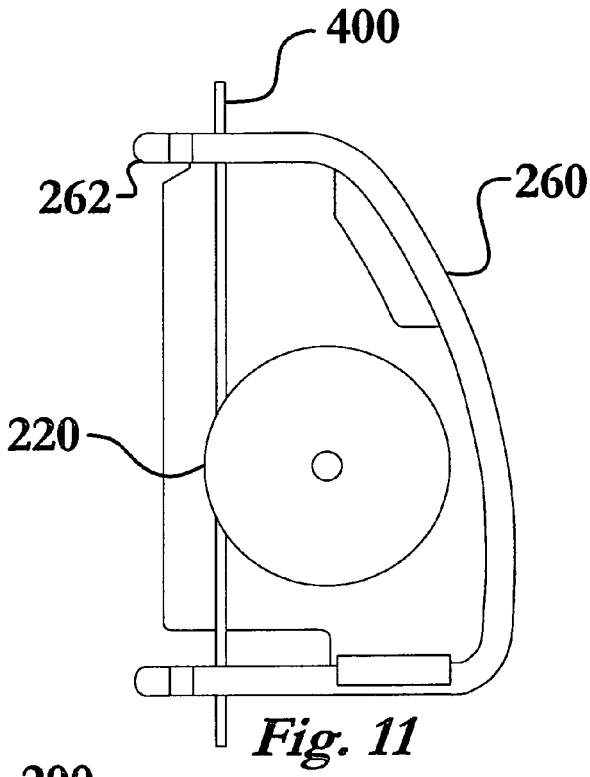
FIG. 11 is a right side elevation view of a hoist of the present invention, not to scale.
Figure 12:
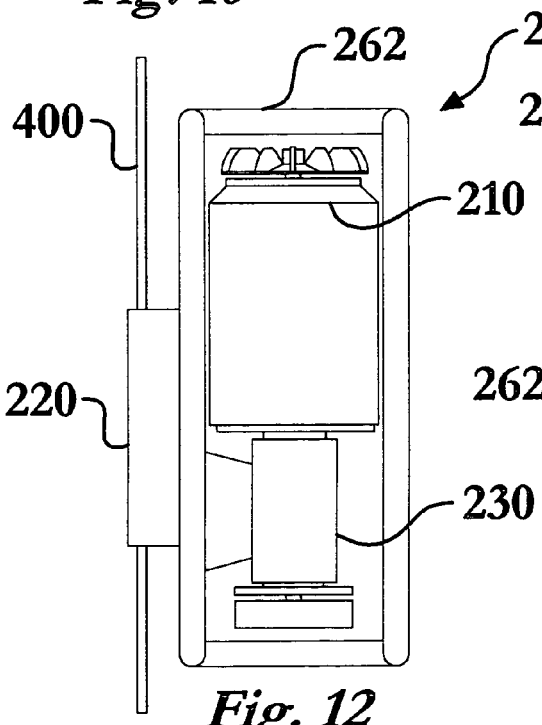
FIG. 12 is a rear elevation view of a hoist of the present invention, not to scale.
Figure 13:
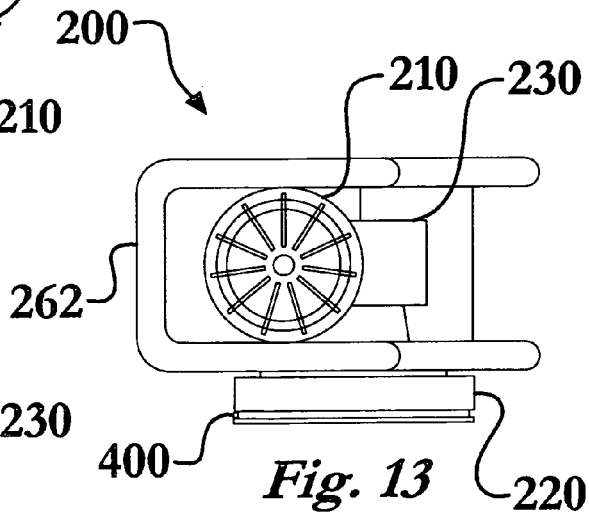
FIG. 13 is a top plan view of a hoist of the present invention, not to scale.

In addition to the sinistral motor (210), the sinistral hoist (200) has a sinistral traction mechanism (220), seen best in FIGS. 11-12, designed to cooperate with the sinistral rope (400), and a sinistral gearbox (230) for transferring power from the sinistral motor (210) to the sinistral traction mechanism (220). Similarly, the dextral hoist (300) has a dextral traction mechanism (320) designed to cooperate with the dextral rope (300), and a dextral gearbox (330) for transferring power from the dextral motor (310) to the dextral traction mechanism (320). The sinistral hoist (220) is releasably attached to the work platform (100) near the sinistral end (110) and the dextral hoist (320) is releasably attached to the work platform (100) near the dextral end (120). The work platform (100) includes a floor (140) and a railing (130), as seen in FIG. 16.

Referring again to FIG. 1, the variable acceleration motor control system (600) is in electrical communication with the constant frequency input power source (800). Such a power source may be any of the conventional alternating current power sources used throughout the world, including, but not limited to, single phase, as well as three phase, 50 Hz, 60 Hz, and 400 Hz systems operating at 110, 120, 220, 240, 380, 480, 575, and 600 volts. The variable acceleration motor control system (600) controls the rate at which the sinistral motor (210) accelerates the sinistral traction mechanism (220) and the rate at which the dextral motor (310) accelerates the dextral traction mechanism (320) thereby controlling the acceleration of the work platform (100) as the work platform (100) is raised and lowered on the sinistral rope (400) and the dextral rope (500).

The variable acceleration motor control system (600) not only controls the acceleration of the work platform (100) in the conventional sense of positive acceleration, but it also controls the negative acceleration, or deceleration, of the work platform (100). Such control not only eliminates bone jarring starts and stops characteristic of single-speed and two-speed hoists, but also provides the ability to slowly approach a particular elevation, from above or below, in a controlled fashion so that the elevation is not passed, or overshot. In fact, in one embodiment the variable acceleration motor control system (600) includes an approach mode having an adjustable approach velocity setpoint which limits the velocity of the work platform (100) to a value of fifty percent, or less, of the maximum velocity.

The variable acceleration motor control system (600) provides the user the ability to control the acceleration and set a particular working velocity of the work platform (100). For example, if the work platform (100) is being used for window washing then the work platform (100) is being advanced relatively short distances at a time, typically 10-12 feet, as the work platform (100) is moved from floor to floor. In such a situation there is no need to allow the work platform (100) to accelerate to the maximum velocity when advancing a floor at a time. Therefore, in one embodiment the variable acceleration motor control system (600) permits the establishment of an adjustable maximum working velocity, which is a great safety improvement because advancing from floor to floor at a controlled working velocity that is a fraction of the maximum velocity reduces the likelihood of accidents.

Such a system still allows the user to command the variable acceleration motor control system (600) to accelerate to the maximum velocity when traversing more significant distances. Therefore, the variable acceleration motor control system (600) controls the acceleration of the work platform (100) so that the work platform (100) reaches a maximum velocity in no less than a predetermined time period to eliminate the bone jarring starts previously discussed as being associated with single-speed and two-speed hoist systems. The time period is a minimum of 1 second, but is more commonly 2-5 seconds, or more, depending on the use of the work platform (100). For instance, greater time periods may be preferred when the work platform (100) is transporting fluids such as window washing fluids or paint.

Figure 2:
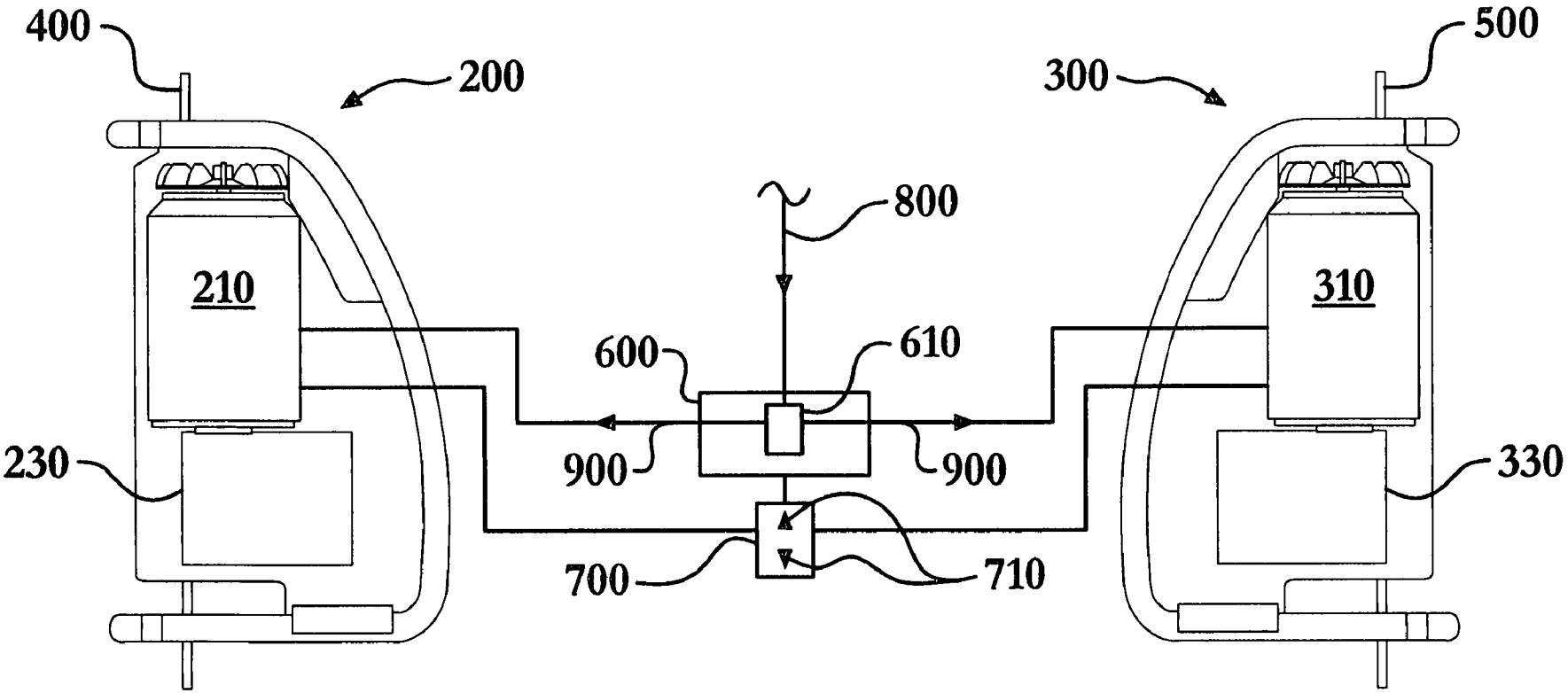
FIG. 2 is a schematic of the suspension work platform hoist system of the present invention, not to scale.

As previously mentioned, the variable acceleration motor control system (600) is in electrical communication with the constant frequency input power (800) and the sinistral motor (210) and dextral motor (310), as seen in FIG. 1. In one embodiment, the variable acceleration motor control system (600) achieves the acceleration control by converting the constant frequency input power to a variable frequency power supply (900) in electrical communication with the motors (210, 310), as seen in FIG. 2. In one particular embodiment the variable acceleration motor control system (600) includes a variable frequency drive (610) that converts the constant frequency input power source (800) to a variable frequency power supply (900) connected to the sinistral motor (210) and the dextral motor (310).

Figure 3:
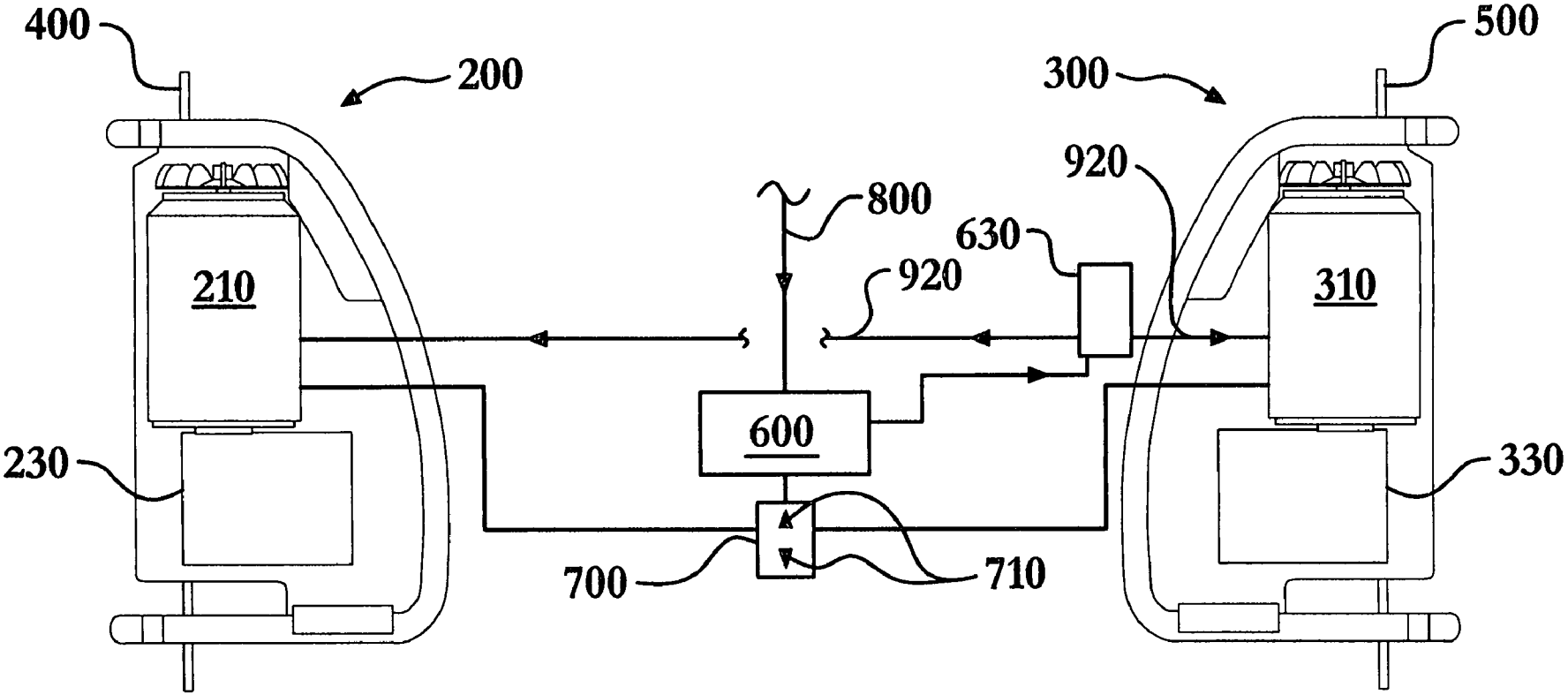
FIG. 3 is a schematic of the suspension work platform hoist system of the present invention, not to scale.
Figure 4:
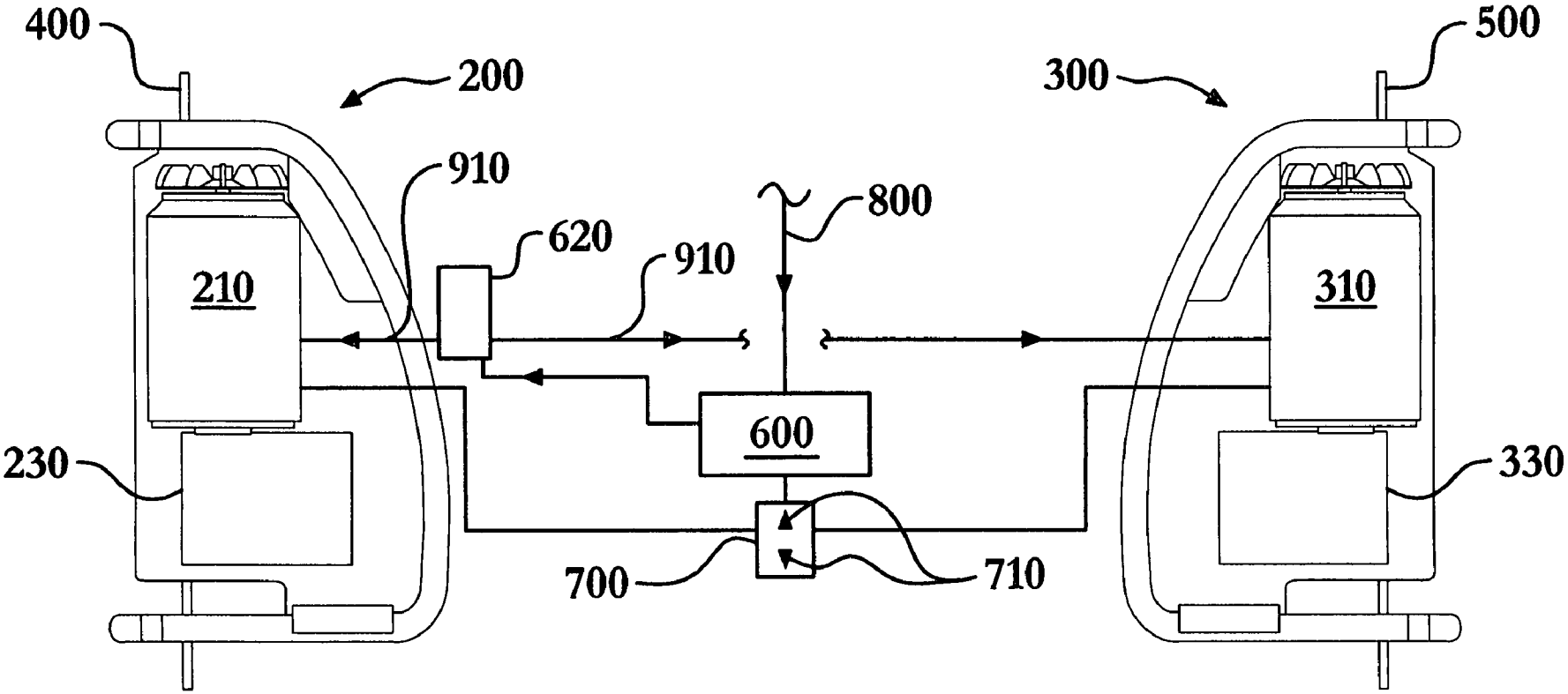
FIG. 4 is a schematic of the suspension work platform hoist system of the present invention, not to scale.

The variable frequency drive (610) embodiment may include a single variable frequency drive (610) to control both the sinistral motor (210) and the dextral motor (310). For example, a single sinistral variable frequency drive (620) may be incorporated to convert the constant frequency input power source (800) to a sinistral variable frequency power supply (910) in electrical communication with the sinistral motor (210) and the dextral motor (310) such that the sinistral motor (210) and the dextral motor (310) are powered in unison by the sinistral variable frequency power supply (910), as seen in FIG. 4. Alternatively, the variable acceleration motor control system (600) may include a dextral variable frequency drive (630) that converts the constant frequency input power source (800) to a dextral variable frequency power supply (920) in electrical communication with the sinistral motor (210) and a dextral motor (310) such that the sinistral motor (210) and the dextral motor (310) are powered in unison by the dextral variable frequency power supply, as seen in FIG. 3. Typically, the single variable frequency drive (610), whether it be the sinistral variable frequency drive (620) or the dextral variable frequency drive (630), is mounted within the body of either the sinistral hoist (200) or the dextral hoist (300), with the rest of the variable acceleration motor control system (600). Therefore, conductors connected to the constant frequency input power source (800) would connect to one of the hoists (200, 300) and power that particular variable frequency drive (610, 620) that would then provide a variable frequency power supply (910, 920) to both motors (210, 310), one with conductors merely connecting the variable frequency drive (610, 620) to the motor (210, 310) within the hoist (200, 300) and the other with conductors traversing the work platform (100) to connect to and power the other hoist (200, 300).

Figure 5:
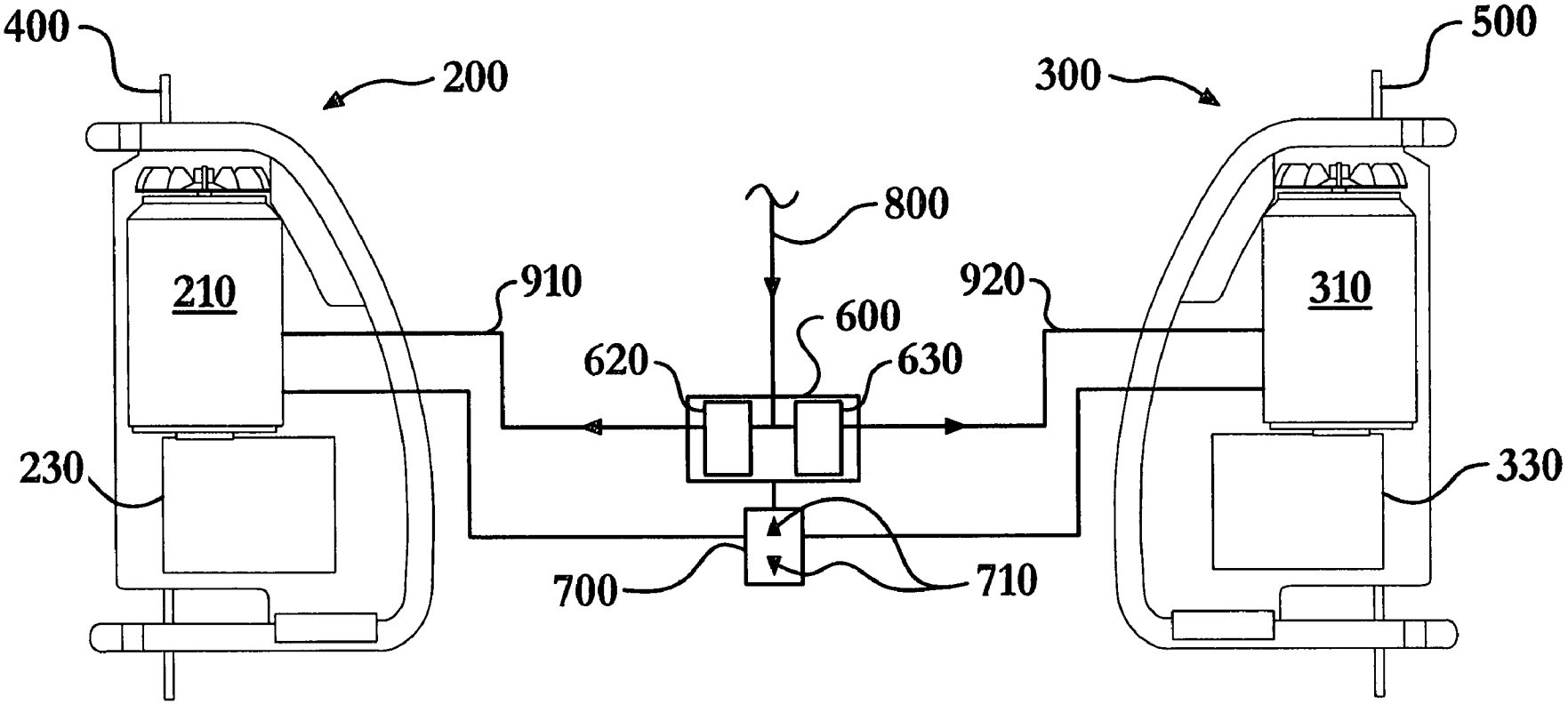
FIG. 5 is a schematic of the suspension work platform hoist system of the present invention, not to scale.
Figure 6:
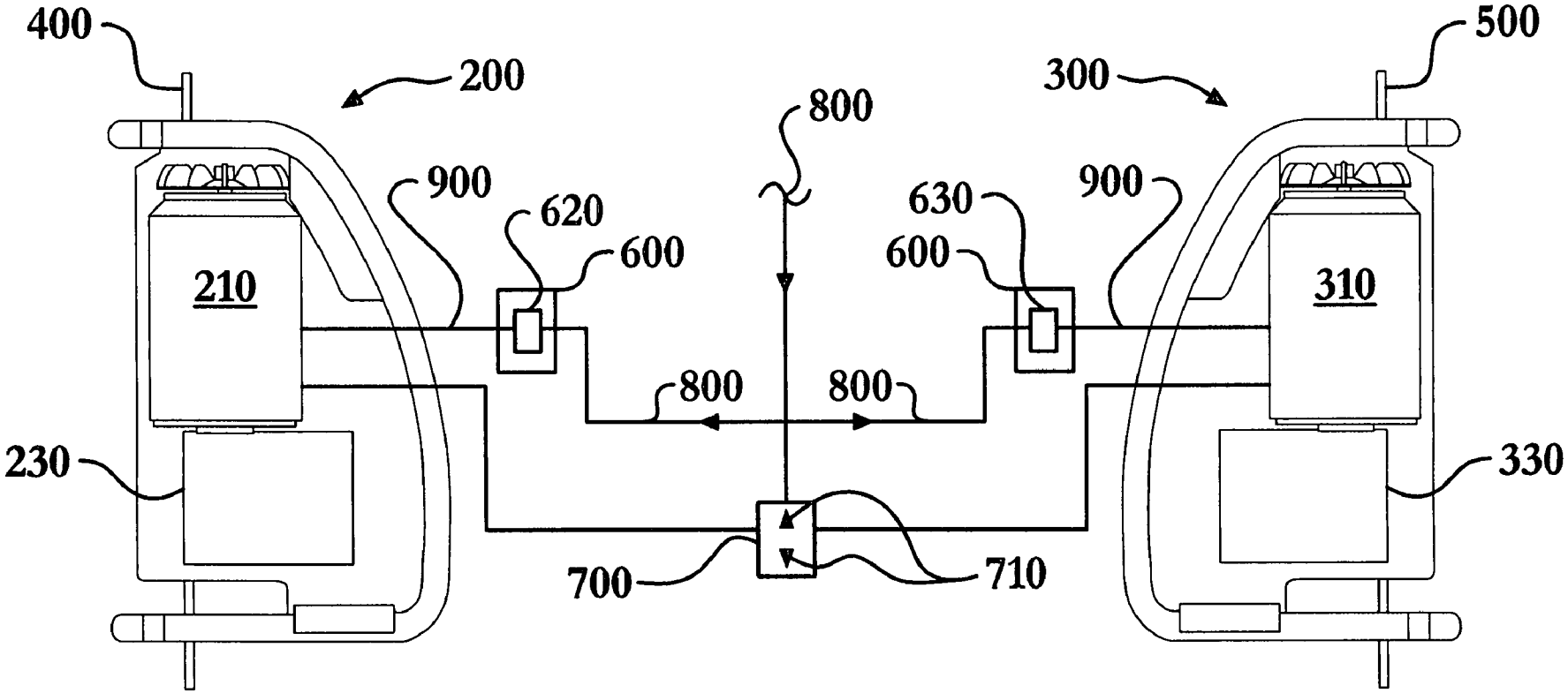
FIG. 6 is a schematic of the suspension work platform hoist system of the present invention, not to scale.

In an alternative variable frequency drive (610) embodiment both the sinistral motor (210) and the dextral motor (310) are associated with their own variable frequency drive, namely a sinistral variable frequency drive (620) and a dextral variable frequency drive (630), as seen in FIGS. 5 and 6. The variable frequency drives (620, 630) may be centrally housed, as seen in FIG. 5, or located at, or in, the individual hoists (200, 300), as seen in FIG. 6. In one embodiment each variable frequency drive (620, 630) powers only the associated motor (210, 310), as seen in FIGS. 5-6. In an alternative embodiment seen in FIGS. 7-9, the sinistral variable frequency drive (620) and a dextral variable frequency drive (630) are each sized to power both motors (210, 310) and never only power a single motor, thereby introducing a field configurable redundant output power supply capability. Referring first to the embodiment of FIG. 6 wherein the sinistral variable frequency drive (620) only powers the sinistral motor (210) and the dextral variable frequency drive (630) only powers the dextral motor (310), the two drives (620, 630) are still a part of the variable acceleration motor control system (600), regardless of the fact that each drive (620, 630) will most likely be housed within the associated hoist (200, 300), and therefore offer all of the previous described control benefits, and each drive (620, 630) may be controlled in unison with a common control signal.

Figure 7:
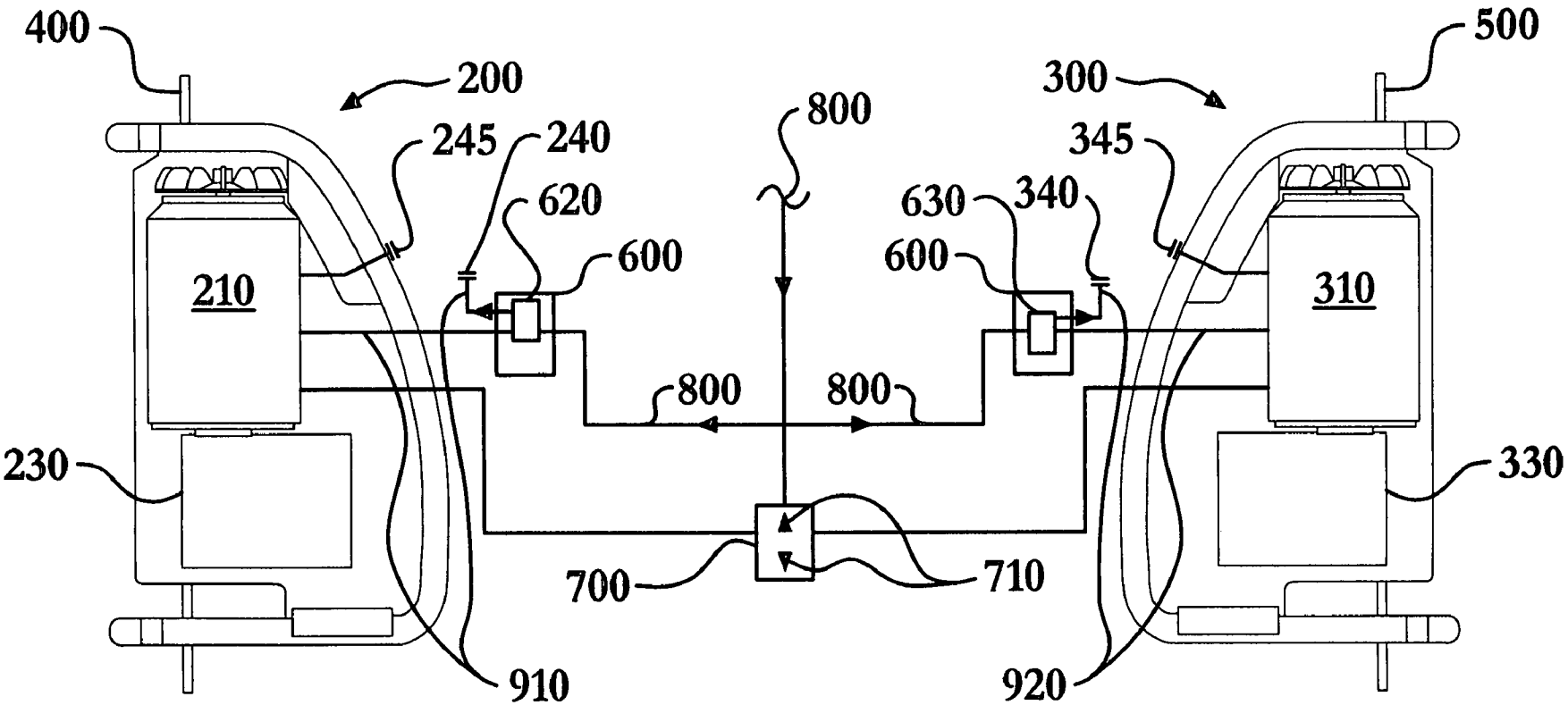
FIG. 7 is a schematic of the suspension work platform hoist system of the present invention, not to scale.
Figure 8:
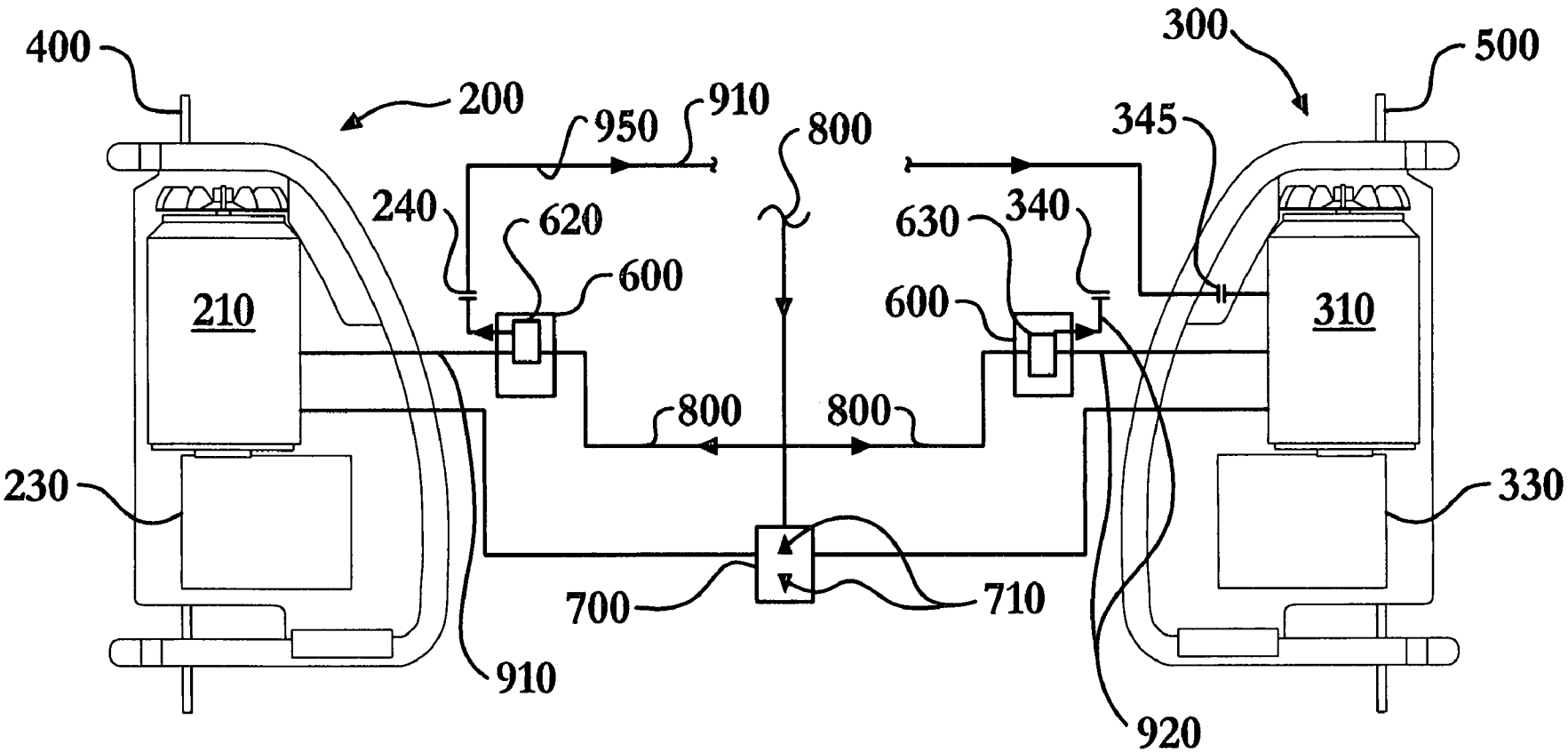
FIG. 8 is a schematic of the suspension work platform hoist system of the present invention, not to scale.
Figure 9:
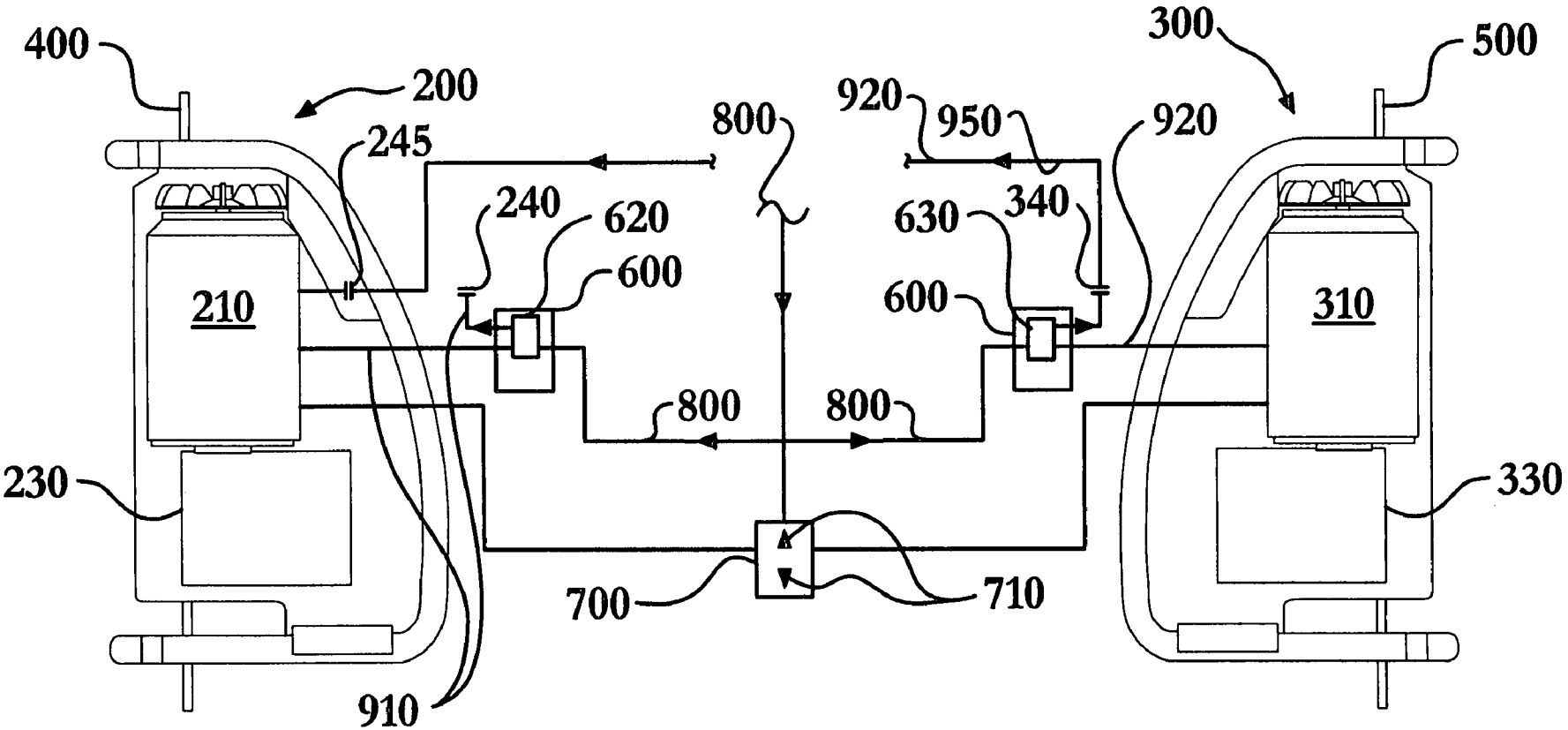
FIG. 9 is a schematic of the suspension work platform hoist system of the present invention, not to scale.
Figure 10:
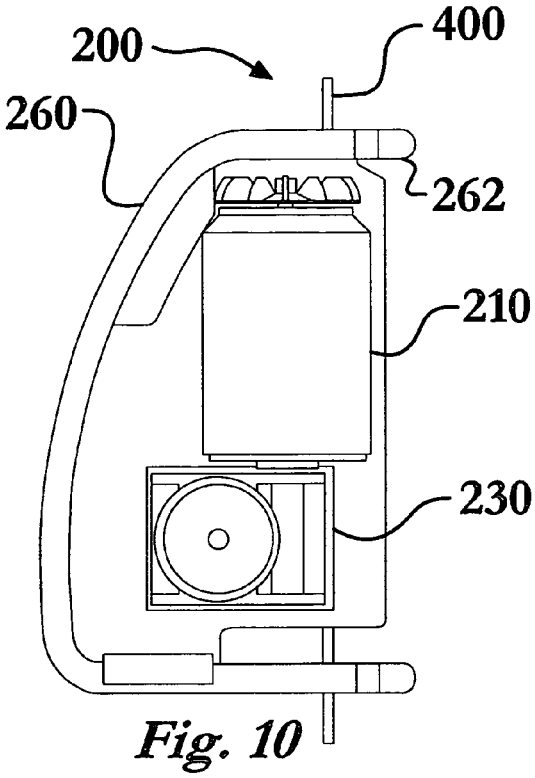
FIG. 10 is a left side elevation view of a hoist of the present invention, not to scale.

Now, referring back to the embodiment of FIGS. 7-9 wherein each drive (620, 630) is sized to power both motors (210, 310), this embodiment is similar to the previously described embodiment of FIG. 2 wherein a single variable frequency drive (610) controls both motors (210, 310), yet the present embodiment introduces redundant capabilities not previously seen. In this embodiment the constant frequency input power source (800) is in electrical communication with both the sinistral variable frequency drive (620), thereby producing a sinistral variable frequency power supply (910), and the dextral variable frequency drive (630), thereby producing a dextral variable frequency power supply (920). The sinistral variable frequency power supply (910) is in electrical communication with the sinistral motor (210) and a dextral output power terminal (240). Similarly, the dextral variable frequency power supply (920) is in electrical communication with the dextral motor (310) and a sinistral output power terminal (340).

Additionally, in this embodiment the sinistral motor (210) is also in electrical communication with a sinistral auxiliary input power terminal (245) and the dextral motor (310) is also in electrical communication with a dextral auxiliary input power terminal (345), as seen schematically in FIG. 7. Therefore, in the configuration of FIG. 8 the variable acceleration motor control system (600) utilizes the sinistral variable frequency drive (620) to control both the sinistral and dextral motors (210, 310), thereby requiring that the dextral output power terminal (240) be in electrical communication with the dextral auxiliary input power terminal (345) via an auxiliary conductor (950). In the alternative configuration of FIG. 9 the variable acceleration motor control system (600) utilizes the dextral variable frequency drive (620) to control both the sinistral and dextral motors (210, 310), thereby requiring that the sinistral output power terminal (340) be in electrical communication with the sinistral auxiliary input power terminal (245) via an auxiliary conductor (950). The auxiliary conductor (950) may be a set of loose conductors or the conductors may be permanently attached to the work platform (100). These embodiments provide the hoist system (10) with a field configurable redundant output power supply capable of controlling the acceleration of the work platform (100) upon failure of either the sinistral variable frequency drive (620) of the dextral variable frequency drive (630).

A further variation of the above embodiment incorporates an alternator that ensures that each time the work platform (100) starts, the opposite variable frequency drive (620, 630) supplies the variable frequency power supply to both motors (210, 310). Alternatively, the alternator may cycle the variable frequency drives (620, 630) based upon the amount of operating time of the drives (620, 630). These embodiments ensure substantially equal wear and tear on the variable frequency drives (620, 630). Still further, the system (10) may incorporate an automatic changeover features so that if one variable frequency drive (620, 630) fails then the other variable frequency drive (620, 630) automatically takes over. As an additional safety measure, the variable frequency drives (610, 620, 630) may incorporate a bypass switch allowing the constant frequency input power source to be directly supplied to the sinistral motor (210) and the dextral motor (310), thereby permitting the variable frequency drives (610, 620, 630) to serve as across-the-line motor starters.

Figure 14:
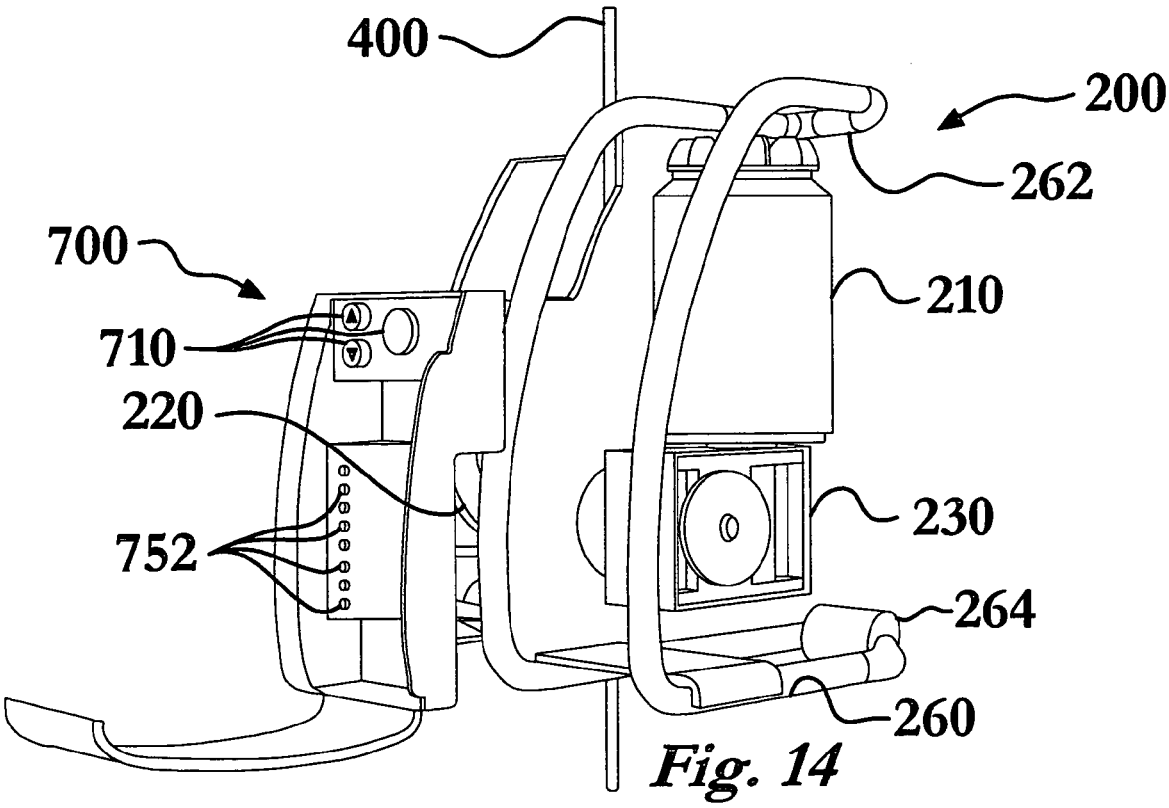
FIG. 14 is a perspective assembly view of a hoist of the present invention, not to scale.
Figure 15:
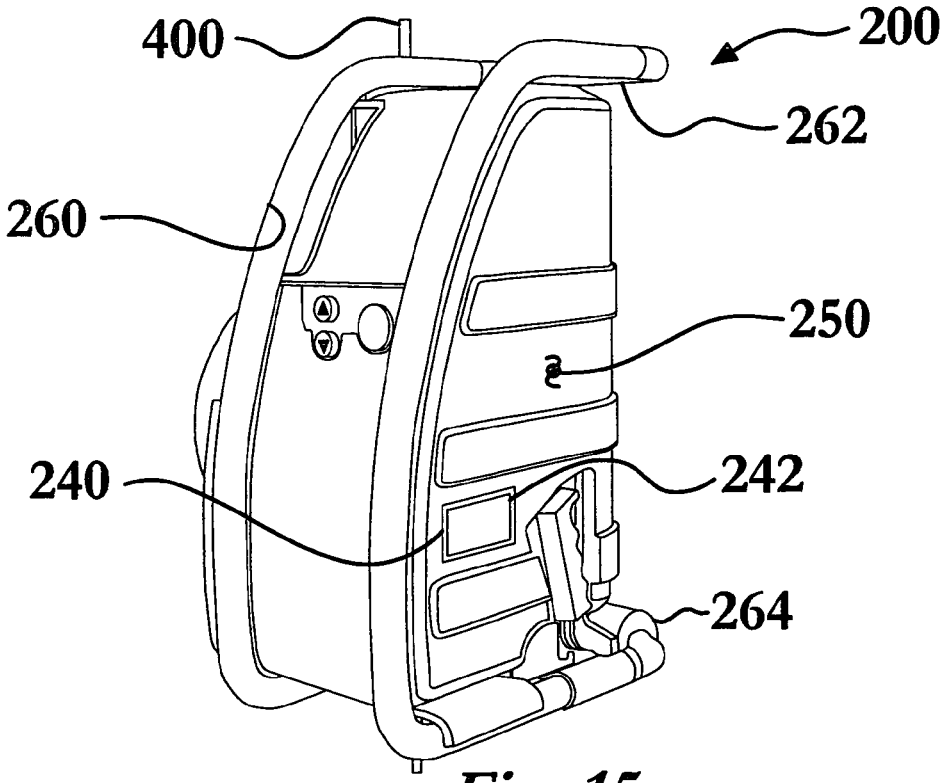
FIG. 15 is a perspective view of a hoist of the present invention.

The present invention may also incorporate enclosures for the hoist components thereby improving the operating safety, equipment life, serviceability, and overall ruggedness. For instance, in one embodiment, seen in FIG. 15, the sinistral motor (210), the sinistral traction mechanism (220), and the sinistral gearbox (230), seen in FIG. 14, are totally enclosed in a sinistral housing (250) attached to a sinistral chassis (260). Similarly, the dextral motor (310), the dextral traction mechanism (320), and the dextral gearbox (330) may be totally enclosed in a dextral housing (350) attached to a dextral chassis (360). Further, with reference now to FIG. 14, the sinistral chassis (260) may include a sinistral handle (262) and at least one rotably mounted sinistral roller (264) configured such that the sinistral hoist (200) pivots about the sinistral roller (264) when the sinistral handle (262) is acted upon, so that the sinistral hoist (200) may be easily transported via rolling motion. Similarly, the dextral chassis (360) may include a dextral handle (362) and at least one rotably mounted dextral roller (364) configured such that the dextral hoist (300) pivots about the dextral roller (364) when the dextral handle (362) is acted upon, so that the dextral hoist (300) may be easily transported via rolling motion. Further, it is often desirable to have very compact hoists (200, 300) so that they may fit through small opening in confined spaces to carry out work. One such occasion is when performing work on the inside of an industrial boiler wherein the access hatches are generally eighteen inches in diameter. Therefore, in one embodiment, seen in FIGS. 14-15, the sinistral hoist (200), sinistral housing (250), and sinistral chassis (260) are configured to pass through an eighteen inch diameter opening and the dextral hoist (300), dextral housing (350), and dextral chassis (360) are configured to pass through an eighteen inch diameter opening.

As previously mentioned, the variable acceleration motor control system (600) is releasably attached to the moving work platform (100). In the embodiments incorporating variable frequency drives (610, 620, 630) and hoist housings (250, 350), the variable frequency drives (610, 620, 630) are most commonly mounted within one, or more, of the hoist housings (250, 350). In fact, in a preferred embodiment the sinistral hoist (200) has its own sinistral variable frequency drive (620) housed within the sinistral hoist housing (250), and similarly the dextral hoist (300) has its own dextral variable frequency drive (630) housed within the dextral hoist housing (350). In such an embodiment, seen in FIG. 15, it is also ideal to have the dextral power terminal (240) as a dextral weather-tight conductor connector (242) located on the sinistral hoist (200), and the sinistral power terminal (340) as a sinistral weather-tight conductor connector (342) located on the dextral hoist (300). The weather-tight conductor connectors (242, 342) and power terminals (240, 340) may be any number of male, or female, industrial plugs and receptacles that cooperate with conductors sized to handle the electrical load of supplying power to either of the motors (210, 310).

In yet another embodiment, the variable acceleration motor control system (600) monitors the constant frequency input power source and blocks electrical communication to the sinistral motor (210) and the dextral motor (310) when the voltage of the constant frequency input power source varies from a predetermined voltage by more than plus, or minus, at least ten percent of the predetermined voltage. Further, the variable acceleration motor control system (600) may incorporate reporting devices to signal to an operator the reason that the system (600) has been shut down. The variable acceleration motor control system (600) may also monitor the load on the sinistral traction mechanism (220) and the dextral traction mechanism (320) and blocks electrical communication to the sinistral motor (210) and the dextral motor (310) if (a) either the sinistral traction mechanism (220) loses traction on the sinistral rope (400) or the dextral traction mechanism (320) loses traction on the dextral rope (500), (b) the load on the work platform (100) exceeds a predetermined value, or (c) the load on the work platform (100) is less than a predetermined value.

The platform control system (700) and the user input device (710) may incorporate functions other than merely accepting instructions to raise or lower the work platform (100). Generally the industry refers to the platform control system (700) as a central control box, which has numerous buttons and switches, or user input devices (710), for controlling the suspension work platform hoist system (10). In most applications the platform control system (700) includes a pendant so that the operator does not need to be located at the user input device (710) to control the movement of the work platform (100). In other words, the user input device (710) may be at least one control switch, button, or toggle located on a fixed central control box or it may be all, or some, of those same devices located on a movable pendent. Generally, the user input device (710) will include up/down hold-to-run switches, hoist selector switches (sinistral, dextral, both), and an emergency stop button. Various embodiments of the present invention may call for the addition of input devices associated with the variable acceleration motor control system (600). Such additional input devices may include (a) approach mode enable/disable, (b) adjustable approach velocity setpoint, (c) work mode enable/disable, (d) adjustable approach velocity setpoint, (e) adjustable acceleration period setpoint, and (f) hoist master/slave selector to identify which hoist generates the control power or control signal and which merely receives the power or control signal and responds accordingly. The platform control system (700) and/or the user input device (720) may incorporate a LCD screen to view diagnostics and setpoints. Further, the LCD screen may be a touch-screen input system.

Even further, the platform control system (700) may incorporate a diagnostic system (750), as seen in FIG. 1, that allows the user to perform specific tests of the system (10) and makes the user aware of certain conditions, and that performs a predetermined set of tests automatically. The diagnostic system (750) permits the user to initiate system tests, or checks, including testing the panel light integrity as well as the level of the input voltage. Further, the diagnostic system (750) may run automatic system tests including (a) ultra-high top limit detection, (b) tilt sensing in up to 4 axes, (c) ultra-bottom limit detection, (d) under load detection, (e) overload detection, (f) fall protection interlock integrity, or Sky Lock interlock integrity, (g) motor temperature, (h) brake voltage level, (i) rope jam sensing, (j) wire-winders integrity, (k) main voltage phase loss integrity, (l) end-of-rope sensing integrity, (m)

digital speed read-out, (n) digital fault display, (o) rope diameter sensing integrity, and/or (p) platform height protector integrity. In other words, the diagnostic system (750) may run automatic tests to ensure that every safety feature is operational and properly functioning. The diagnostic system (750) automatic tests may be programmed to run every time the hoist is operated, or on an alternative schedule. The diagnostic system (750) may include any number of visual indicators (752), seen in FIG. 14, to alert the user of particular conditions. For instance, each of the above listed automatic tests may have a unique visual indicator (752) to inform the user whether the test was a success, or failure. The visual indicators (752) may be light emitting diodes, or LED's.

Another advantage of the present platform control system (700) is that it incorporates a printed circuit board (PCB), thereby offering functionality and flexibility not previously seen in hoist system. The PCB facilitates the easy incorporation of numerous optional features by simply plugging them into the appropriate ports on the PCB allowing an unprecedented degree of modularity. The control system software includes plug-and-play type features that automatically recognize new components plugged into the PCB. The substrate of the PCB is an insulating and non-flexible material. The thin wires are visible on the surface of the board are part of a copper foil that initially covered the whole board. In the manufacturing process the copper foil is partly etched away, and the remaining copper forms a network of thin wires. These wires are referred to as the conductor pattern and provide the electrical connections between the components mounted on the PCB. To fasten the modular components to the PCB the legs on the modular components are generally are soldered to the conductor pattern or mounted on the board with the use of a socket. The socket is soldered to the board while the component can be inserted and taken out of the socket without the use of solder. In one embodiment the socket is a ZIF (Zero Insertion Force) socket, thereby allowing the component to be inserted easily in place, and be removable. A lever on the side of the socket is used to fasten the component after it is inserted. If the optional feature to be incorporated requires its own PCB, it may connect to the main PCB using an edge connector. The edge connector consists of small uncovered pads of copper located along one side of the PCB. These copper pads are actually part of the conductor pattern on the PCB. The edge connector on one PCB is inserted into a matching connector (often referred to as a Slot) on the other PCB. The modular components mentioned in this paragraph may include a GPS tracking device (720) and a wireless receiver (740), just to name a few.

The platform control system (700) may further include a GPS tracking device (720), shown schematically in FIG. 1. The GPS tracking device (720) allows the owner of the suspension work platform hoist system (10) to track its location real-time. The GPS tracking device (720) may be a battery powered 12, or more, channel GPS system capable of up to 120 days of operation based upon 10 reports a day, powered by 6 AA alkaline batteries or 6-40 VDC. The GPS tracking device (720) has an internal antenna and memory to record transmissions when cellular service is poor or lost. The GPS tracking device (720) may be motion activated.

The GPS tracking device (720) may be manufactured by UTrak, Inc., a Miniature Covert GPS Tracking System Item#: SVGPS100, a RigTracker tracking system, or a Laipac Technology, Inc. tracking system, just to name a few.

Further, still referring to FIG. 1, the platform control system (700) may include a remote wireless transmitter (730) and a receiver (740) wherein the remote wireless transmitter (730) transmits commands to the receiver (740) using spread spectrum communications. The remote wireless transmitter (730) may include some, or all, of the controls of the user input device(s) (710) discussed herein. The spread spectrum communications may utilize digital frequency hopping or analog continuous frequency variation, generally on 900 MHz to 2.4 GHz carrier freqeuencies. Additionally, the remote wireless transmitter (730) is capable of transmitting commands to the receiver (740) with a range of at least one thousand feet, and up to three thousand feet. Spread spectrum communications are less susceptible to interference, interception, exploitation, and spoofing than conventional wireless signals. This is important due to the safety concerns associated with controlling a suspended work platform (100) from a remote location. The spread spectrum communication system varies the frequency of the transmitted signal over a large segment of the electromagnetic radiation spectrum, often referred to as noise-like signals. The frequency variation is done according to a specific, but complicated, mathematical function often referred to as spreading codes, pseudo-random codes, or pseudo-noise codes. The transmitted frequency changes abruptly many times each second. The spread spectrum signals transmit at a much lower spectral power density (Watts per Hertz) than narrowband transmitters.

The variable frequency drives (610, 620, 630) discussed herein control the speed, torque, direction, and resulting horsepower of the sinistral motor (210) and the dextral motor (310). The variable frequency drives (610, 620, 630) may be of the voltage-source inverter (VSI) type or current-source inverter (CSI) type. The variable frequency drives (610, 620, 630) may incorporate silicon control rectifier (SCR) technology, insulated gate bipolar transistors (IGBT), or pulse-width-modulation (PWM) technology. The variable frequency drives (610, 620, 630) provide soft-start capability that decreases electrical stresses and line voltage sags associated with full voltage motor starts.

The variable frequency drives (610, 620, 630) current ratings shall be 4 kHz or 8 kHz carrier frequency. The variable frequency drives (610, 620, 630) may automatically reduce the carrier frequency as load is increased. The variable frequency drives (610, 620, 630) may incorporate manual stop/start, speed control, local/remote status indication, manual or automatic speed control selection, and run/jog selection. Additionally, the variable frequency drives (610, 620, 630) may incorporates a command center to serve as a means to configure controller parameters such as Minimum Speed, Maximum Speed, Acceleration and Deceleration times, Volts/Hz ratio, Torque Boost, Slip Compensation, Overfrequency Limit, and Current Limit. The variable frequency drives (610, 620, 630) may include an LED display mounted on the door of the cabinet that digitally indicates frequency output, voltage output, current output, motor RPM, input kW, elapsed time, time-stamped fault indication, and/or DC Bus Volts. The variable frequency drives (610, 620, 630) includes multiple programmable preset speeds which will force the variable frequency drives (610, 620, 630) to a preset speed upon a user contact closure. Further, the variable frequency drives (610, 620, 630) may include an isolated electrical follower capability to enable it to follow a 0-20 mA, 4-20 mA or 0-4, 0-8, 0-10 volt DC grounded or ungrounded speed signal. Additionally, the variable frequency drives (610, 620, 630) may provide isolated 0-10 V or 4-20 ma output signals for computer controlled feedback signals that are selectable for speed or current. The variable frequency drives (610, 620, 630) may include the following protective features: output phase-to-phase short circuit condition, total ground fault under any operating condition, high input line voltage, low input line voltage, and/or loss of input or output phase. The variable frequency drives (610, 620, 630) shall provide variable acceleration and deceleration periods of between 0.1 and 999.9 seconds. The variable frequency drives (610, 620, 630) is capable of continuous operation at an ambient temperature of 0° C. to 40° C.

The traction mechanisms (220, 320) discussed herein are designed to grip the respective ropes (400, 500) and may be of the solid sheave type, which are known in the art and are currently available via Sky Climber, Inc. of Stone Mountain, Ga. Further, the gearboxes (230, 330) are planetary and worm gear systems designed to reduce the rotational speed of the motors (210, 310) to a usable speed. One with skill in the art will appreciate that other gear systems may be incorporated in the gearboxes (210, 310). Additionally, the power terminals (240, 245, 340, 345) discussed herein can take virtually any form that facilitate the establishment of electrical communication between the terminal and a conductor. While the disclosure herein refers to two hoists, namely the sinistral hoist (200) and the dextral hoist (300), one with skill in the art will appreciate that the suspension work platform hoist system (10) of the present invention may incorporate a single hoist or more than two hoists. Similarly, while the present description focuses on a single rope (400, 500) per hoist (200, 300), one with skill in the art will appreciate that the present invention also covers applications that require multiple ropes for each hoist, as is common in Europe.

Each of the housings (250, 350) may include separate compartments for housing the controls and electronics. Generally, the electronic components used in the system (10) must be maintained within a given ambient temperature range, thus it is convenient to house all such components in a temperature controlled environment. The temperature of the electronics compartment may be maintained using any number of conventional temperature maintenance methods commonly known by those with skill in the art. Alternatively, the compartment may be coated with an altered carbon molecule based coating that serves to maintain the compartment at a predetermined temperature and reduce radiation.

Numerous alterations, modifications, and variations of the preferred embodiments disclosed herein will be apparent to those skilled in the art and they are all anticipated and contemplated to be within the spirit and scope of the instant invention. For example, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the present invention are described herein, it is to be understood that the practice of such additional modifications and variations and the equivalents thereof, are within the spirit and scope of the invention as defined in the following claims. The corresponding structures, materials, acts, and equivalents of all means or step plus function elements in the claims below are intended to include any structure, material, or acts for performing the functions in combination with other claimed elements as specifically claimed.

We claim:

1. A powered controlled acceleration suspension work platform hoist system (10) for raising and lowering a work platform (100), having a sinistral end (110) and a dextral end (120), on a sinistral rope (400) and a dextral rope (500) at a predetermined acceleration, comprising:

a sinistral hoist (200) having a sinistral motor (210), a sinistral traction mechanism (220) designed to cooperate with the sinistral rope (400), and a sinistral gearbox (230) for transferring power from the sinistral motor (210) to the sinistral traction mechanism (220), wherein the sinistral hoist (220) is releasably attached to the work platform (100) near the sinistral end (110);

a dextral hoist (300) having a dextral motor (310), a dextral traction mechanism (320) designed to cooperate with the dextral rope (300), and a dextral gearbox (330) for transferring power from the dextral motor (310) to the dextral traction mechanism (320), wherein the dextral hoist (320) is releasably attached to the work platform (100) near the dextral end (120);

a variable acceleration motor control system (600) releasably attached to the work platform (100) and in electrical communication with a constant frequency input power source and the sinistral motor (210) and the dextral motor (310) wherein the variable acceleration motor control system (600) controls the rate at which the sinistral motor (210) accelerates the sinistral traction mechanism (220) and the rate at which the dextral motor (310) accelerates the dextral traction mechanism (320) thereby controlling the acceleration of the work platform (100) as the work platform (100) is raised and lowered on the sinistral rope (400) and the dextral rope (500); and a platform control system (700) releasably attached to the work platform (100) and in electrical communication with the variable acceleration motor control system (600), the sinistral motor (210), and the dextral motor (300), having a user input device (710) designed to accept instructions to raise or lower the work platform (100).

2. The powered controlled acceleration suspension work platform hoist system (10) of claim 1, wherein the variable acceleration motor control system (600) converts the constant frequency input power source to a variable frequency power supply connected to the sinistral motor (210) and the dextral motor (310).

3. The powered controlled acceleration suspension work platform hoist system (10) of claim 2, wherein the variable acceleration motor control system (600) includes a variable frequency drive (610) that converts the constant frequency input power source to a variable frequency power supply connected to the sinistral motor (210) and the dextral motor (310).

4. The powered controlled acceleration suspension work platform hoist system (10) of claim 2, wherein the variable acceleration motor control system (600) includes a sinistral variable frequency drive (620) that converts the constant frequency input power source to a sinistral variable frequency power supply in electrical communication with the sinistral motor (210) and a dextral motor (310) such that the sinistral motor (210) and the dextral motor (310) are powered in unison by the sinistral variable frequency power supply.

5. The powered controlled acceleration suspension work platform hoist system (10) of claim 2, wherein the variable acceleration motor control system (600) includes a dextral variable frequency drive (630) that converts the constant frequency input power source to a dextral variable frequency power supply in electrical communication with the sinistral motor (210) and a dextral motor (310) such that the sinistral motor (210) and the dextral motor (310) are powered in unison by the dextral variable frequency power supply.

6. The powered controlled acceleration suspension work platform hoist system (10) of claim 2, wherein the variable acceleration motor control system (600) includes a sinistral variable frequency drive (620) that converts the constant frequency input power source to a sinistral variable frequency power supply in electrical communication with the sinistral motor (210) and a dextral variable frequency drive (630) that converts the constant frequency input power source to a dextral variable frequency power supply in electrical communication with the dextral motor (310).

7. The powered controlled acceleration suspension work platform hoist system (10) of claim 6, wherein the sinistral variable frequency power supply is also in electrical communication with a dextral power terminal (240) and the sinistral variable frequency drive (620) is sized such that the sinistral variable frequency power supply can power both the sinistral motor (210) and the dextral motor (310) if the dextral power terminal (240) is placed in electrical communication with the dextral motor (310), and the dextral variable frequency power supply is also in electrical communication with a sinistral power terminal (340) and the dextral variable frequency drive (630) is sized such that the dextral variable frequency power supply can power both the dextral motor (310) and the sinistral motor (210) if the sinistral power terminal (340) is placed in electrical communication with the sinistral motor (210), thereby providing the hoist system (10) with a field configurable redundant output power supply capable of controlling the acceleration of the work platform (100) as the work platform (100) is raised and lowered on the sinistral rope (400) and the dextral rope (500) upon failure of either the sinistral variable frequency drive (620) of the dextral variable frequency drive (630).

8. The powered controlled acceleration suspension work platform hoist system (10) of claim 7, wherein the sinistral variable frequency drive (620) and the dextral variable frequency drive (630) incorporate a bypass switch so that the constant frequency input power source may be directly supplied to the sinistral motor (210) and the dextral motor (310).

9. The powered controlled acceleration suspension work platform hoist system (10) of claim 2, wherein the variable acceleration motor control system (600) monitors the constant frequency input power source and blocks electrical communication to the sinistral motor (210) and the dextral motor (310) when the voltage of the constant frequency input power source varies from a predetermined voltage by more than plus, or minus, at least ten percent of the predetermined voltage.

10. The powered controlled acceleration suspension work platform hoist system (10) of claim 2, wherein the variable acceleration motor control system (600) monitors the load on the sinistral traction mechanism (220) and the dextral traction mechanism (320) and blocks electrical communication to the sinistral motor (210) and the dextral motor (310) if the either the sinistral traction mechanism (220) loses traction on the sinistral rope (400) or the dextral traction mechanism (320) loses traction on the dextral rope (500).

11. The powered controlled acceleration suspension work platform hoist system (10) of claim 7, wherein the sinistral variable frequency drive (620) is within the sinistral hoist (200) and the dextral power terminal (240) is a dextral weather-tight conductor connector (242) located on the sinistral hoist (200), and the dextral variable frequency drive (630) is within the dextral hoist (300) and the sinistral power terminal (340) is a sinistral weather-tight conductor connector (342) located on the dextral hoist (300).

12. The powered controlled acceleration suspension work platform hoist system (10) of claim 2, wherein the variable acceleration motor control system (600) controls the acceleration of the work platform (100) so that the work platform (100) reaches a maximum velocity in no less than 1 second.

13. The powered controlled acceleration suspension work platform hoist system (10) of claim 2, wherein the variable acceleration motor control system (600) controls the acceleration of the work platform (100) so that the work platform (100) reaches a maximum velocity in no less than 2 seconds.

14. The powered controlled acceleration suspension work platform hoist system (10) of claim 2, wherein the variable acceleration motor control system (600) controls the acceleration of the work platform (100) so that the work platform (100) reaches a maximum velocity in no less than 5 seconds.

15. The powered controlled acceleration suspension work platform hoist system (10) of claim 2, wherein the variable acceleration motor control system (600) includes an approach mode having an adjustable approach velocity setpoint which limits the velocity of the work platform (100) to a value of fifty percent, or less, of a maximum velocity.

16. The powered controlled acceleration suspension work platform hoist system (10) of claim 1, wherein the platform control system (700) further includes a diagnostic system (750) that runs a predetermined number of tests prior to allowing the sinistral hoist (200) and the dextral hoist (300) to move the work platform (100).

17. The powered controlled acceleration suspension work platform hoist system (10) of claim 16, wherein the predetermined number of tests includes verification that the temperature of the sinistral motor (210) and the temperature of the dextral motor (310) is within an acceptable range, and verification of the proper operation of the end-of-rope sensing system.

18. The powered controlled acceleration suspension work platform hoist system (10) of claim 16, wherein the diagnostic system (750) further includes at least one visual indicator (752) to alert the user if any of the tests failed.

19. The powered controlled acceleration suspension work platform hoist system (10) of claim 1, wherein the platform control system (700) further includes at least one modular printed circuit board having at least one unused socket designed to cooperatively and releasably receive a modular option device comprising one or more of the group consisting of a GPS tracking device (720) and a wireless receiver (740).

20. The powered controlled acceleration suspension work platform hoist system (10) of claim 2, wherein the platform control system (700) further includes a GPS tracking device (720).

21. The powered controlled acceleration suspension work platform hoist system (10) of claim 2, wherein the platform control system (700) further includes a remote wireless transmitter (730) and a receiver (740) wherein the remote wireless transmitter (730) transmits commands to the receiver (740) using spread spectrum communications.

22. The powered controlled acceleration suspension work platform hoist system (10) of claim 21, wherein the spread spectrum communications utilize digital frequency hopping.

23. The powered controlled acceleration suspension work platform hoist system (10) of claim 21, wherein the spread spectrum communications utilize analog continuous frequency variation.

24. The powered controlled acceleration suspension work platform hoist system (10) of claim 21, wherein the remote wireless transmitter (730) transmits commands to the receiver (740) with a range of at least one thousand feet.

25. The powered controlled acceleration suspension work platform hoist system (10) of claim 1, wherein the sinistral motor (210), the sinistral traction mechanism (220), and the sinistral gearbox (230) are totally enclosed in a sinistral housing (250) attached to a sinistral chassis (260) having a sinistral handle (262) and at least one rotably mounted sinistral roller (264) configured such that the sinistral hoist (200) pivots about the sinistral roller (264) when the sinistral handle (262) is acted upon so that the sinistral hoist (200) may be easily transported via rolling motion, and the dextral motor (310), the dextral traction mechanism (320), and the dextral gearbox (330) are totally enclosed in a dextral housing (350) attached to a dextral chassis (360) having a dextral handle (362) and at least one rotably mounted dextral roller (364) configured such that the dextral hoist (300) pivots about the dextral roller (364) when the dextral handle (362) is acted upon so that the dextral hoist (300) may be easily transported via rolling motion, wherein the sinistral hoist (200), sinistral housing (250), and sinistral chassis (260) are configured to pass through and eighteen inch diameter opening and the dextral hoist (300), dextral housing (350), and dextral chassis (360) are configured to pass through and eighteen inch diameter opening.

26. A powered controlled acceleration suspension work platform hoist system (10) for raising and lowering a work platform (100), having a sinistral end (110) and a dextral end (120), on a sinistral rope (400) and a dextral rope (500) at a predetermined acceleration, comprising:

a sinistral hoist (200) having a sinistral motor (210), a sinistral traction mechanism (220) designed to cooperate with the sinistral rope (400), and a sinistral gearbox (230) for transferring power from the sinistral motor (210) to the sinistral traction mechanism (220), wherein the sinistral hoist (220) is releasably attached to the work platform (100) near the sinistral end (110);

a dextral hoist (300) having a dextral motor (310), a dextral traction mechanism (320) designed to cooperate with the dextral rope (300), and a dextral gearbox (330) for transferring power from the dextral motor (310) to the dextral traction mechanism (320), wherein the dextral hoist (320) is releasably attached to the work platform (100) near the dextral end (120);

a variable acceleration motor control system (600) releasably attached to the work platform (100) and in electrical communication with a constant frequency input power source and the sinistral motor (210) and the dextral motor (310) wherein the variable acceleration motor control system (600) incorporates a variable frequency drive (610) to convert the constant frequency input power source to a variable frequency power supply connected to the sinistral motor (210) and the dextral motor (310), and controls the rate at which the sinistral motor (210) accelerates the sinistral traction mechanism (220) and the rate at which the dextral motor (310) accelerates the dextral traction mechanism (320) thereby controlling the acceleration of the work platform (100) as the work platform (100) is raised and lowered on the sinistral rope (400) and the dextral rope (500), wherein the variable acceleration motor control system (600) controls the acceleration of the work platform (100) so that the work platform (100) reaches a maximum velocity in no less than 1 second, and the variable acceleration motor control system (600) includes an approach mode having an adjustable approach velocity setpoint which limits the velocity of the work platform (100) to a value of fifty percent, or less, of a maximum velocity; and a platform control system (700) releasably attached to the work platform (100) and in electrical communication with the variable acceleration motor control system (600), the sinistral motor (210), and the dextral motor (300), having a user input device (710) designed to accept instructions to raise or lower the work platform (100).

27. A powered controlled acceleration suspension work platform hoist system (10) for raising and lowering a work platform (100), having a sinistral end (110) and a dextral end (120), on a sinistral rope (400) and a dextral rope (500) at a predetermined acceleration, comprising:

a sinistral hoist (200) having a sinistral motor (210), a sinistral traction mechanism (220) designed to cooperate with the sinistral rope (400), and a sinistral gearbox (230) for transferring power from the sinistral motor (210) to the sinistral traction mechanism (220), wherein the sinistral hoist (220) is releasably attached to the work platform (100) near the sinistral end (110), wherein the sinistral motor (210), the sinistral traction mechanism (220), and the sinistral gearbox (230) are totally enclosed in a sinistral housing (250) attached to a sinistral chassis (260) having a sinistral handle (262) and at least one rotably mounted sinistral roller (264) configured such that the sinistral hoist (200) pivots about the sinistral roller (264) when the sinistral handle (262) is acted upon so that the sinistral hoist (200) may be easily transported via rolling motion, and the sinistral hoist (200), sinistral housing (250), and sinistral chassis (260) are configured to pass through and eighteen inch diameter opening;

a dextral hoist (300) having a dextral motor (310), a dextral traction mechanism (320) designed to cooperate with the dextral rope (300), and a dextral gearbox (330) for transferring power from the dextral motor (310) to the dextral traction mechanism (320), wherein the dextral hoist (320) is releasably attached to the work platform (100) near the dextral end (120), wherein the dextral motor (310), the dextral traction mechanism (320), and the dextral gearbox (330) are totally enclosed in a dextral housing (350) attached to a dextral chassis (360) having a dextral handle (362) and at least one rotably mounted dextral roller (364) configured such that the dextral hoist (300) pivots about the dextral roller (364) when the dextral handle (362) is acted upon so that the dextral hoist (300) may be easily transported via rolling motion, and the dextral hoist (300), dextral housing (350), and dextral chassis (360) are configured to pass through and eighteen inch diameter opening;

a variable acceleration motor control system (600) releasably attached to the work platform (100) and in electrical communication with a constant frequency input power source and the sinistral motor (210) and the dextral motor (310) wherein the variable acceleration motor control system (600) incorporates a sinistral variable frequency drive (620) that converts the constant frequency input power source to a sinistral variable frequency power supply in electrical communication with the sinistral motor (210) and a dextral variable frequency drive (630) that converts the constant frequency input power source to a dextral variable frequency power supply in electrical communication with the dextral motor (310), and controls the rate at which the sinistral motor (210) accelerates the sinistral traction mechanism (220) and the rate at which the dextral motor (310) accelerates the dextral traction mechanism (320) thereby controlling the acceleration of the work platform (100) as the work platform (100) is raised and lowered on the sinistral rope (400) and the dextral rope (500), wherein the variable acceleration motor control system (600) controls the acceleration of the work platform (100) so that the work platform (100) reaches a maximum velocity in no less than 5 seconds, and the variable acceleration motor control system (600) includes an approach mode having an adjustable approach velocity setpoint which limits the velocity of the work platform (100) to a value of fifty percent, or less, of a maximum velocity, and wherein the sinistral variable frequency power supply is also in electrical communication with a dextral power terminal (240) and the sinistral variable frequency drive (620) is sized such that the sinistral variable frequency power supply can power both the sinistral motor (210) and the dextral motor (310) if the dextral power terminal (240) is placed in electrical communication with the dextral motor (310), and the dextral variable frequency power supply is also in electrical communication with a sinistral power terminal (340) and the dextral variable frequency drive (630) is sized such that the dextral variable frequency power supply can power both the dextral motor (310) and the sinistral motor (210) if the sinistral power terminal (340) is placed in electrical communication with the sinistral motor (210), thereby providing the hoist system (10) with a field configurable redundant output power supply capable of controlling the acceleration of the work platform (100) as the work platform (100) is raised and lowered on the sinistral rope (400) and the dextral rope (500) upon failure of either the sinistral variable frequency drive (620) of the dextral variable frequency drive (630); and a platform control system (700) releasably attached to the work platform (100) and in electrical communication with the variable acceleration motor control system (600), the sinistral motor (210), and the dextral motor (300), having a user input device (710) designed to accept instructions to raise or lower the work platform (100), a GPS tracking device (720), and a remote wireless transmitter (730) and a receiver (740) wherein the remote wireless transmitter (730) transmits commands to the receiver (740) using digital frequency hopping spread spectrum communications.

* * * * *